US005244201A

United States Patent [19]

Balcerek et al.

[11] Patent Number: 5,244,201

[45] Date of Patent: Sep. 14, 1993

[54] SIGNATURE STREAM INTERRUPT APPARATUS AND METHOD

[75] Inventors: Gregory Balcerek, Wayne; Irving H. Neumann, Somerville, both of N.J.; Timothy E. Goszka, Easton, Pa.

[73] Assignee: Stacker Machine Co., Mountainside, N.J.

[21] Appl. No.: 717,931

[22] Filed: Jun. 20, 1991

[51] Int. Cl.[5] ..... B65H 29/66

[52] U.S. Cl. ..... 271/202

[58] Field of Search ..... 271/3.1, 151, 182, 191, 271/200, 202, 258, 270, 216, 275

[56] References Cited

U.S. PATENT DOCUMENTS

| | | | |
|---|---|---|---|
| 3,315,956 | 4/1967 | Lyman | 271/202 X |
| 3,378,258 | 4/1968 | Leuhrs . | |
| 3,911,800 | 10/1975 | Feldkamper | 271/202 X |
| 4,133,523 | 1/1979 | Berthelot | 271/202 X |
| 4,245,832 | 1/1981 | Klenk et al. . | |
| 4,311,090 | 1/1982 | Dudziak et al. . | |
| 4,372,201 | 2/1983 | Dudziak et al. . | |
| 4,397,229 | 8/1983 | Merwarth et al. . | |
| 4,398,455 | 8/1983 | Merwarth . | |
| 4,516,759 | 5/1985 | Kobler | 271/202 X |
| 4,541,763 | 9/1985 | Chandjoke et al. . | |
| 4,554,867 | 11/1985 | Thumm . | |
| 4,570,535 | 2/1986 | Higgins et al. . | |
| 4,678,387 | 7/1987 | Sjorgen et al. . | |
| 4,718,656 | 1/1988 | Reist | 271/202 X |
| 4,723,883 | 2/1988 | Smith . | |
| 4,750,732 | 6/1988 | Hara et al. | 271/202 X |
| 4,772,003 | 9/1988 | Nobuta et al. . | |
| 5,054,763 | 10/1991 | Achelpohl et al. | 271/202 X |

FOREIGN PATENT DOCUMENTS

| | | |
|---|---|---|
| 387205 | 12/1988 | Austria . |
| 2022045 | 11/1971 | Fed. Rep. of Germany . |
| 2640032 | 11/1982 | Fed. Rep. of Germany . |
| 1102788 | 7/1968 | United Kingdom . |
| 1268895 | 3/1972 | United Kingdom . |

*Primary Examiner*—Robert P. Olszewski
*Assistant Examiner*—Boris Milef
*Attorney, Agent, or Firm*—Mathews, Woodbridge & Collins

[57] ABSTRACT

The present invention relates to an apparatus and method for interrupting a stream of signatures. The apparatus comprises successive conveyor belts in series which can be controlled to advance the belt supporting surfaces at relatively different speeds. At least one conveyor belt has a supporting surface capable of varying in length.

27 Claims, 2 Drawing Sheets

SIGNATURE STREAM INTERRUPT APPARATUS AND METHOD

BACKGROUND OF THE INVENTION

1. Field of the Invention

The present invention relates to an apparatus and method for interrupting a stream of signatures; more particularly, the present invention relates to a signature stream interrupt having successive conveyor belts in series which can be controlled to advance their supporting surfaces at relatively different speeds and the first conveyor belt being capable of having the supporting surface vary in length.

2. Description of Related Art

Various industries, particularly the printing industry, process a plurality of sheet-like articles commonly referred to as signatures. Signatures have a major plane and a perimeter which are typically rectangular or square. The signatures leave the printing press or folding machine where they are acted upon in a signature stream. The successive signatures have a forward end and a back end referred to as a tail. The front end overlaps the tail of the succeeding signatures to form a shingled stream. In this way, a continuous stream of signatures is transferred from one operation to the next. The signatures stream can move at rapid speeds from up to 80,0000 signatures per hour.

During various operations to handle and process signatures, it is desirable to separate a plurality of signatures into discreet increments. For example, signatures coming from a printing press are typically stacked in bundles having a desired number of signatures. In order to form such stacks without impacting on the operation of the printing or folding machines, it is desirable to interrupt the flow of signatures or form a gap in the stream. The signatures can be stacked without disturbing the formation of the signature from behind the gap.

Stacking apparatus are well known in the art. Common stacking machines include horizontal stackers and vertical stackers. Horizontal stackers stack the signatures with individual signatures in a vertical position supported on an edge. The stack has a stack axis which is horizontal. Vertical stackers have a vertical stacking support which supports the major plane of the signatures. The term "vertical" is nominal, and used to indicate that a stack is formed with a stack axis vertical or at an angle to the horizontal, typically greater than 45° and most commonly at 45° to 75°.

There is disclosed in the art a wide variety of horizontal and vertical stacking machines. These machines are designed to stack sheets of paper, including "signatures". Typically, the signatures have a major plane and a perimeter and are stacked with the major planes of adjacent signatures in contact with the signature perimeters aligned. The signatures are usually rectangular shaped as they are fed from a printer or folding machine. Signatures are fed at a high rate of speed to the stacker, by a conveyor belt assembly.

Useful horizontal stackers are disclosed in U.S. Pat. Nos. 4,723,883: 4,570,535 4,245,832 and 3,378,258. Vertical stackers are also widely known and disclosed in U.S. Pat. Nos. 4,311,090; 4,372,201; 4,678,387; and 4,541,763. Stackers of interest are also disclosed in U.S. Pat. Nos. 4,398,455; 4,397,229; and 4,772,003.

Vertical stackers comprise a vertical stacking table having a vertical support wall. The vertical signature support wall extends from a feed end to a discharge end.

The vertical signature support is nominally vertically, but typically at an angle of from 1° to 45° to the vertical. In this way the forming stack rests against the vertical support wall. The vertical stacking table has a sliding signature support fork which can translate up and down along the vertical support wall. The signature support fork can be transverse to and extending from the vertical support track. A stack is squared between the sliding signature support fork and the vertical signature support wall. There can be a feed fork assembly which supports the oncoming signatures as the stack begins to form. The forming stack is transferred from the feed fork to the primary fork. The formed stack on the primary support fork is removed to a bundling and strapping apparatus where the stack is compressed and strapped to form a bundle.

In forming the bundles it is desirable to have end boards or end plates at either longitudinal end of the stack. Apparatus to automatically insert end boards during the stacking operation are disclosed in U.S. Pat. Nos. 4,372,201; 4,311,090; and 4,554,867. Yet another approach is presented in U.S. Pat. No. 4,772,003. The state of the art has been such that the end boards are carefully fit at the ends of the stack. This is because of the rapidly moving and growing stack of signatures.

Reference is made to commonly assigned U.S. Ser. No. 07/688,039, filed Apr. 19, 1991 and hereby incorporated by reference. This patent, as well as certain of the disclosed patents, indicates that prior to stacking it is desirable to interrupt the flow of the signatures stream. This application discloses a vertical stacker in which a gapper or interrupt apparatus is located between the stacker feed conveyor system and a vertical stacker. This enables a finite number of stack of signatures to be stacked and bundled without disturbing the flow of signatures from the preceding operation.

Apparatus to interrupt the flow of signatures are known in the art and are disclosed in references such as AT 387,205; DE 2,022,045; DE 2,640,032; GB 1,102,788 and GB 1,268,895.

These references indicate a state of the art in forming gaps in moving signatures streams. Typically, a pinch roll hook or other means can be used to intercept the moving stream. The signatures ahead of the intercept proceed unencumbered while those behind the interrupt accumulate for a brief period to attain a desired gap length or time between the last signature past the interrupt or gapper and the first signature which is being interrupted.

A continuing problem with interrupting a stream of rapidly moving signatures is the bunching up of signatures in a non-uniform manner immediately behind the gapping means. The signature stream continually feeds into the gapper and loses its shingled configuration with some signatures bunching directly on top of the preceding signatures. There is always a risk that a loose signature will move past the gapper leaving one or more signatures in the gap. Such loose or stray signatures can inhibit the uniform treatment of the finite stream after the gapper. Therefore, a continual concern in interrupting the flow of a high speed signature stream is a stray signature in the gap. The high speed operations to stack the gapped stream of signatures can be disturbed.

SUMMARY OF THE INVENTION

The present invention relates to an apparatus and method for interrupting a stream of signatures. The apparatus comprises successive conveyor belts in series which can be controlled to advance the belt supporting surfaces at relatively different speeds. At least one conveyor belt has a supporting surface capable of varying in length.

A preferred apparatus of the present invention comprises a first conveyor belt. The first conveyor belt comprises at least one first belt having a belt axis and a first support section axially extending from a feed end to a transfer end.

There is a means to drive the first belt at a controlled speed whereby the first support section advances from the feed end to the transfer end. There is a means to vary the length of the first support section while the first belt is being driven. A preferred means to vary the length comprises an accumulator means. By an accumulator, it is meant a means which correspondingly accumulates a corresponding length change in another section of the belt as the support section of the belt changes length.

Preferably, the first conveyor belt comprises a feed end roll, a transfer end roll, and a brake roll. The first belt forms a continuous path around the feed end, transfer end and brake rolls with the first support section extending from the feed end roll to the transfer end roll. There is an accumulator section extending from the transfer end roll around the brake roll to the feed end roll. There are optionally and preferably additional rolls to define the accumulator section.

A transfer roll translation means enables the transfer roll to move axially toward and away from the feed roll. The preferred transfer roll translation means comprises a track and a carriage disposed to move along the track. The carriage is interconnected to the transfer roll to move the transfer roll parallel to the belt axis. The support section can thereby increase and decrease in length.

In a preferred embodiment the first conveyor belt further comprises an outer surface, an inner surface, with the brake roll interconnected to the carriage and being along the accumulator section between the transfer roll and the feed end roll. There is preferably a drive roll along the accumulator section between the brake roll and the feed end roll. The outer surface of the belt preferably travels around part of the brake roll. As the first support surface is lengthened or decreased, the accumulator section between the brake roll and the driven roll correspondingly decreases or increases in length. The transfer roll translation means enables the brake roll to move when the transfer roll moves to maintain the length of the continuous path. The brake roll is interconnected to the transfer roll translation means.

The second conveyor belt comprises at least one second belt having a second support surface axially extending from a receiving end to a discharge end. The first and second belts extend parallel to the belt axis. There is at least one first belt and at least one second belt. The first and second belts alternate in a direction transverse to the belt axis. Preferably, the receiving end of the second conveyor belt is axially located between the feed end and the transfer end of the first conveyor belt. The support section of the second conveyor belt is disposed to receive articles from the first conveyor belt. Typically, the support section of the second conveyor belt is slightly below that of the first conveyor belt. There is a means to drive the second conveyor belt so that the second support section advances from the receiving end to the discharge end.

The present invention includes a method of operating the apparatus recited above to form gaps in a stream of moving signatures. In accordance with the present invention a stream of signatures is fed at rates up to 80,000 or more signatures an hour, and typically at a rate of up to 60,000 signatures per hour and more typically 5,000 to 40,000 per hour.

A stream of signatures is fed onto the first support section. The first support section is driven to advance from the feed end to the transfer end of the first conveyor belt. The length of the first support section is varied while the belt is being driven. The stream of signatures is transferred from the transfer end of the first conveyor belt to the second conveyor belt which is driven so as to advance the second support section from the receiving end to the discharge end of the second conveyor belt.

During typical operation a signature stream is fed at an initial speed which is typically the speed at which the signatures are fed from a printing and folding operation. The rate at which the signatures stream is fed to the interrupt is typically continuous and unaffected by the interrupt apparatus of the present invention. The speed of the support surfaces of the first and second conveyor belts is equal. This speed is equal to the speed at which the signatures stream is being fed to the interrupt apparatus and is also equal to the speed at which the signatures stream moves away from the apparatus to a further processing means, such as a stacker. To form a gap, the speed of the first conveyor belt support surface is slowed relative to the speed of the second conveyor belt. When this occurs, the signatures on the second and faster conveyor belt move away from the signatures on the slower, first conveyor belt. In order to increase the gap, the transfer end of the first conveyor belt moves axially in the direction of the stream at the same rate as the first conveyor belt is being driven. This causes the portion of the signature stream to build up on that belt while the portion of the signatures stream which was transferred to the second belt moves away at the more rapid second belt speed. The movement of the transfer end of the first conveyor belt maintains the signatures on that belt at a slower speed for a longer period of time. The continuous movement of the first support surface assures a uniform stream of signatures on the first conveyor belt. Because the first conveyor belt is moving at a slower rate than the signatures stream is being fed, the signatures stream on that belt remains uniform but the distance between the shingled signatures decreases. Therefore, the leading edge of the first signature is closer to the leading edge of the successive signature than when the belt is running at the speed of the press or the signatures feed stream.

The support surface of the first belt increases during formation of the gap. The first belt support surface is a driven belt at a slower speed than the initial feed rate of the signatures stream. To decrease the speed and increase the length of the first support surface, a brake is applied to the first belt and the brake roll is pulled by the drive roll with the belt stationary at the brake roller. As the drive roll rotates, a length of belt is driven around the drive roll and the feed roll. The belt does not travel around the transfer roll. The transfer roll moves away from the feed end roll at the rate that the belt is being driven. In effect, the drive roll pulls the transfer roll away from the feed roll. This causes the length of the support section to increase. Correspondingly, the length of the accumulator section between the brake roll and drive roll decreases. Upon reaching a predetermined distance the brake is released and a suitable means, such as a carriage return piston, returns the transfer roll to its original distance. As the transfer roll is shortening, the first belt is driven so as to continue to cause the first support surface to move from the feed roll to the transfer roll at the same speed as the second belt.

During formation of the gap the speed of the first belt can vary from 25% up to 100% of the speed of the initial speed of the shingled signature stream. The speed of the second belt is greater than that of the first belt and can be fed up to 150% or more of the speed of the initial shingled signature stream.

The present invention can have a pinch roll or other means to stop the signatures before the signatures flow from the transfer end of the first belt to the receiving end of the second belt. There can optionally be a second pinch roll which acts in concert with the first pinch roll to pinch a signature to the second conveyor belt at the same time a signature is pinched to the first conveyor belt. The distance between the pinch rolls can be controlled. Preferably the distance is at least equal to the distance of one signature so that the leading edge of the signature is under the second pinch roll while the tailing edge of the signatures is under the first pinch roll. The use of these two pinch rolls, particularly two in concert prevents stray signatures from being released into the gap. After the gap is formed, all of the belt speeds return to the speed at which the signatures stream is being fed.

The present invention is particularly adaptable to a system where a signature stream is fed from a printing and/or folding operation. The signature stream is fed to the interrupt apparatus of the present invention. From there the gapped signature stream is fed to a signature stacking means. Preferred signature stacking means include vertical and horizontal stackers.

DESCRIPTION OF THE PREFERRED EMBODIMENTS

The preferred embodiments of the apparatus and method of the present invention will be apparent to those skilled in the art by reference to the accompanying Figures.

Figure 1:
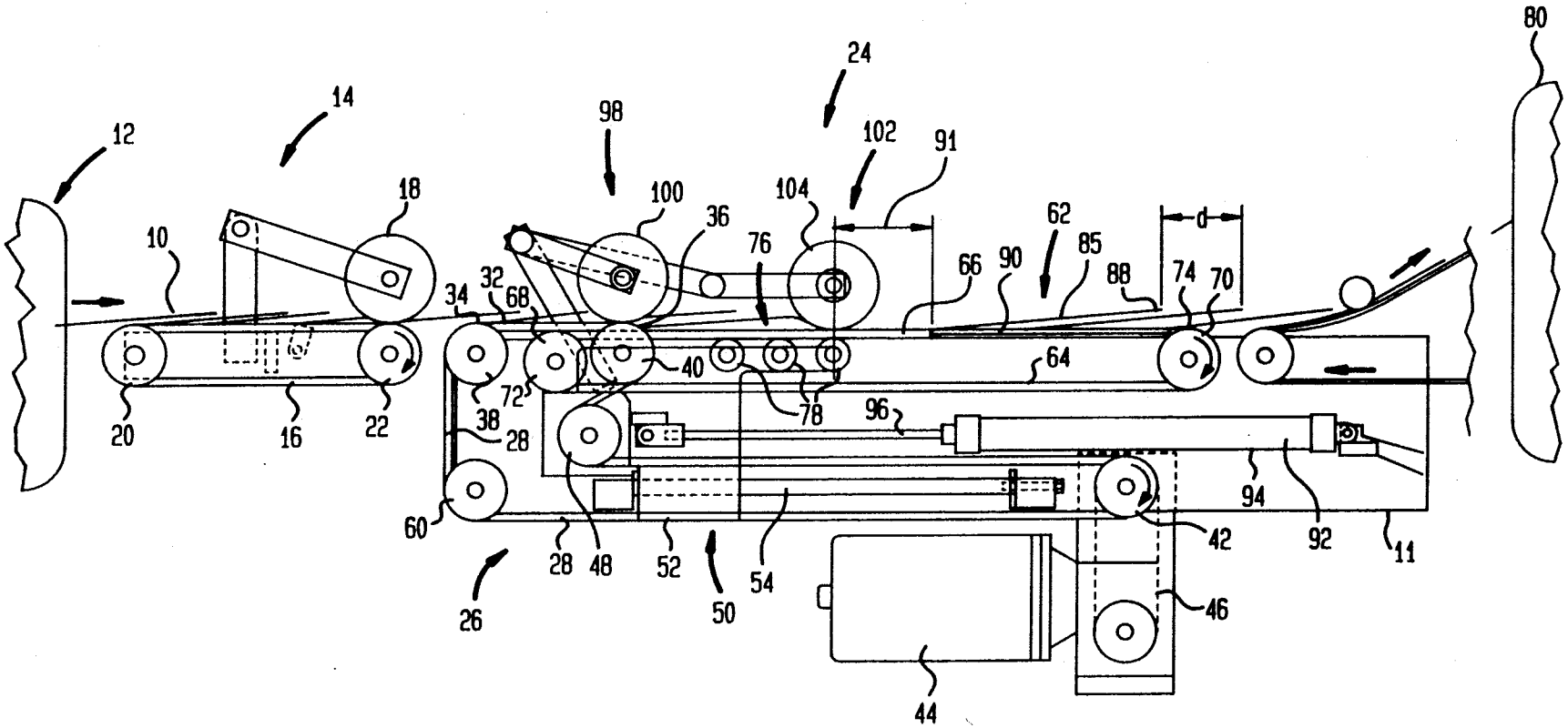
FIG. 1 is a side view of the apparatus of the present invention showing a feed belt to feed a signature stream to the apparatus which discharges a signature stream to a signature stacker.

The present invention is directed to an apparatus and method by which a gap is formed in a stream of signatures. FIG. 1 is a side view showing the apparatus of the present invention as part of a system. A stream of signatures is generated by a signature source such as a printing press 12. Alternately, the signature stream can be generated from a folding and/or cutting apparatus. The signature stream moves from the printing press 12 to an optional conveyor belt 14. Feed conveyor 14 is shown with a feed belt 16 and a feed belt pinch roll 18. The feed belt 16 is a continuous belt moving around feed belt rollers 20 and 22. Feed belt roller 22 is shown to be driven. The feed belt conveyor 16 typically moves at the same speed as the signature stream coming from the printing press 12.

The signature stream 10 then moves to the interrupt or gapping apparatus 24. The gapping apparatus 24 comprises a first conveyor belt 26. The first conveyor belt 26 comprises at least one and preferably two to six, and more preferably three to four first belts 28. The conveyor belt 26 is in the same direction as belt axis 30 to which first belts 28 are parallel. The first belt 28 has a first support section 32. The first support section 32 extends axially from a feed end 34 to a transfer end 36. Preferably, there is a feed end roll 38 at feed end 34 and a transfer end roll 40 at transfer end 36. The first support section 32 extends from feed end roll 38 to transfer end roll 40.

There is a means to drive the first belt 28 at a controlled speed whereby the first support section 32 advances from the feed end 34 to the transfer end 36. The preferred means to drive can be driven roll 42 which is driven by a suitable means such as drive motor 44 connected to driven roll 42 by drive chain 46. The first belt 28 thereby passes around feed end roll 38 and transfer roll 40, as well as driven roll 42. The first belt 28 is a closed loop and continually moves around the path defined by feed roll 38, transfer end roll 40 and driven roll 42.

The gapping apparatus 24 has a means to vary the length of the first support section 32. Preferably, the means to vary the length is a means to axially move the transfer end 36 relative to the feed end 34 while the first belt 28 is being driven. A preferred means to vary the length of the first support section 32 is by the use of an accumulator means. A preferred accumulator means comprises the drive means, such as drive roll 42 which continues to drive the first belt 28. The first belt 28 in contact with the drive roll moves around the drive roll 42 and feed end roll 38. There is a means to brake or stop the conveyor belt between the transfer end 36 and the drive roll 42. Such a means could be a brake means associated with transfer end roll 40. However, there is preferably a separate brake roll 48 located between transfer end roll 40 and drive roll 42.

There is a means to enable transfer end roll 40 to move axially toward and away from the feed end 34. A preferred means is a carriage system 50 on which transfer end roll 40 and brake roll 48 are mounted. The carriage has a carriage support 52 and a carriage track 54. The carriage track 54 is preferably axial in direction. In the preferred embodiment illustrated in FIGS. 1 and 2, there is a carriage support 52 disposed on the lateral sides of transfer end roll 40 and brake roll 48. The transfer roll 40 and brake roll 48 are rotatably mounted to the carriage supports 52 at transfer end roll axle 56 and a corresponding brake roll axle 58. The carriage supports 52 on either side of the rolls are slidably connected to a carriage track 54. The carriage tracks 54 are axial so that when the carriage support 52 move along the carriage tracks 54 they move axially in the direction of the belt axis 30 to and away from the feed end 34.

In a preferred embodiment the driven roll 42 is located so that the path of first belt 28 between the brake roll 48 and the driven roll 42 is parallel to the belt axis 30. The path of first belt 28 from driven roll 42 extends to feed end roll 38. There is optionally and preferably an auxiliary roll 60 between drive roll 42 and feed end roll 38. As shown in FIG. 1, auxiliary roll 60 is located so that the path of belt 28 between driven roll 42 and auxiliary roll 60 is also parallel to the belt axis 30. The drive roll 42 and the auxiliary roll 60 are preferably in a common plane and parallel to the belt axis 30. Auxiliary roll 60 is preferably located so that the path of first belt 28 from auxiliary roll 60 to feed end roll 38 is vertical. In this preferred embodiment, the first belt has a continuous and enclosed path. The first belt 28 extends parallel to belt axis 30 from feed end roll 38 to transfer end roll 40, around brake roll 48 and axially to drive roll 42, from driven roll 42 to auxiliary roll 60 and back around feed end roll 38.

During normal operation when no gap is to be formed, the driven roll 42 causes first belt 28 to move along the enclosed path. The first support section 32 of the first belt 28 is from feed end roll 38 to transfer end roll 40. When there is no need to form a gap the speed of the first support section 38 is driven so that it is equal to the speed of the signature stream 10 from the feed conveyor 16. Thereby, the first belt 28 operates as a normal conveying means. The first support section 32 conveys the signature stream to the transfer end 36.

The apparatus further comprises a second conveyor belt generally shown as reference character 62. The second conveyor belt 62 comprises at least one second belt 64 having a second conveyor belt support section 66 axially extending from receiving end 68 to discharge end 70. The second conveyor belt 62 extends parallel to belt axis 30 from receiving end 68 to the discharge end 70. Preferably there is a receiving end roll 72 at the receiving end 68 and a discharge end roll 74 at the discharge end 70. The second belt forms a continuous, enclosed path around the receiving end roll 72 and the discharge end roll 74. The second support section 68 extends from the receiving end roll 72 to the discharge end roll 74. Preferably one of the rolls is driven. In FIG. 1 discharge end roll 74 is driven. The second belt 64 is driven in a direction so that the second support section 68 moves from the receiving 68 to the discharge end 70.

Figure 2:
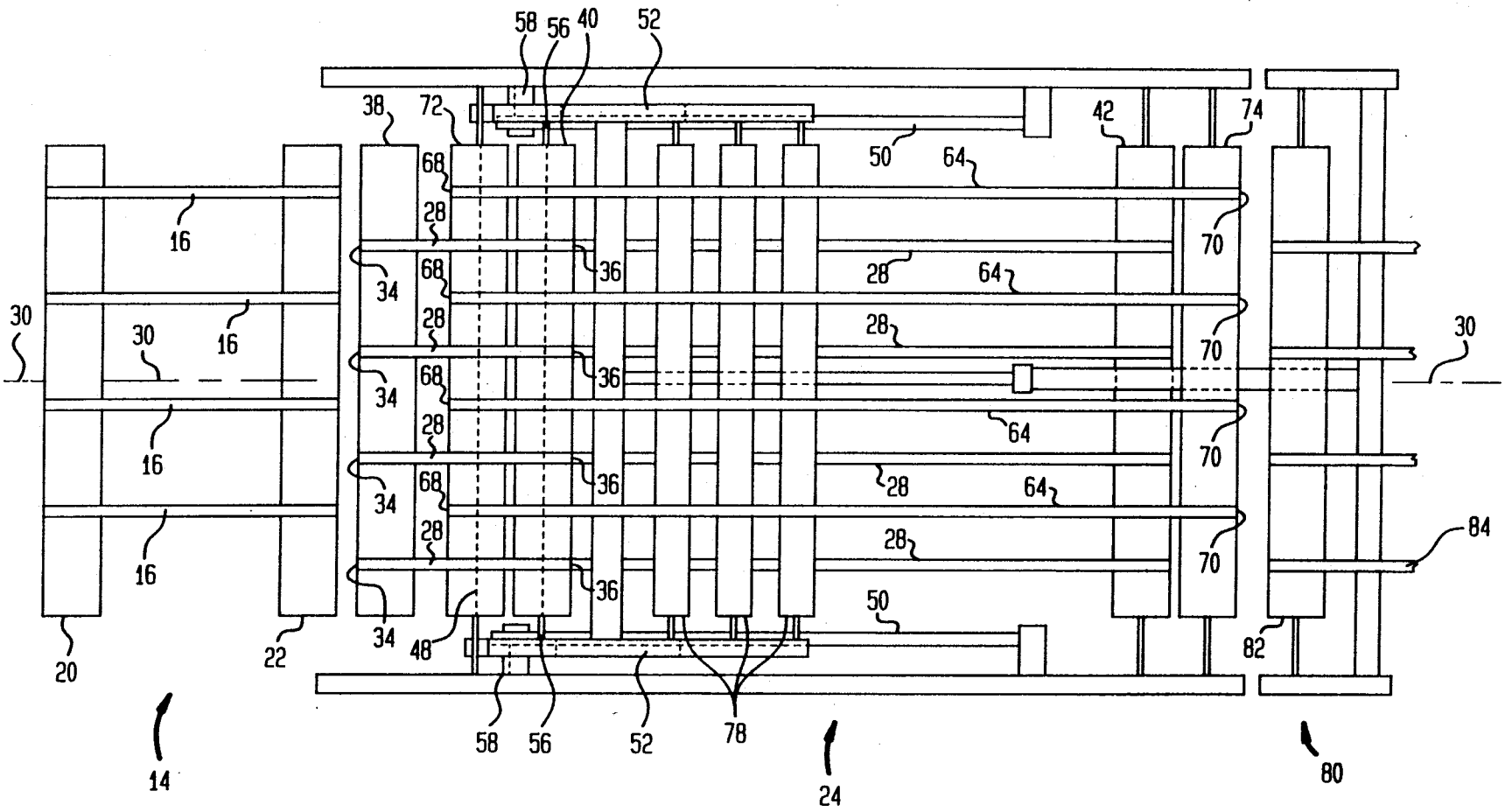
FIG. 2 is a plan view of the interrupt apparatus shown in FIG. 1 without the pinch rolls.

Optionally and preferably, the carriage has a second support section support means 76. The second support section support means 76 is shown in FIGS. 1 and 2 as a plurality of second support rollers 78. Second support rolls 78 are interconnected to carriage supports 52 so as to roll on the roller axes immediately beneath second belt 64. The second support rolls 78 are preferably located where the signature stream 10 is transferred from the first support section 32 to the second support section 66.

The signature stream 10 is carried on the second conveyor belt support section 68 to the discharge end 70 from where it is transferred to the next operating step. In the preferred system of the present invention the next operating step is a stacker means generally shown as reference character 80. The stacker means 80 is shown partially in FIGS. 1 and 2 as having a stacker receiving roll 82 and conveyor means such as conveyor belt 84. In this way the signature moves smoothly from the printer 12 to the feed belt 14 through the gapper apparatus 24 of the present invention 24 and finally through the stacker means 80. The shingles 86 have a shingle head 88 and a shingle tail 90. The shingle space is the distance "d" between successive shingle heads or tails in the signature stream 10 which can vary as desired. The shingle spacing is typically from ½ to 3 inches. When gapping apparatus of the type known in the art is used, the shingles 86 immediately behind the gapping apparatus uncontrollably piles up or bunches. In accordance with the present invention, during gapping operation the first conveyor belt support section 32 moves away from the transfer end 36 at a slower rate than the second conveyor belt support section 66. This slower rate is slower than the rate of signature stream from the printing press causing the shingles to close up or causing the shingle spacing "d" to be reduced. A gap 91 is formed in the signature stream 10. The gap 91 increases while the first support section 32 is moving slower than the second support section 66, with the first support section 32 preferably increasing in length. As the shingles reach the slower moving first support section 32 they slow down but continue to move with the support section as it increases in length, thereby reducing the shingle spacing "d" between the shingles in a controlled fashion so as to result in a uniform, but more concentrated shingled stream effect immediately behind the gap 91. The signature stream 10 moving ahead of the gap has a uniform shingling of the signatures.

The carriage system 50 enables the transfer end 36 to move away from the feed end 34 to increase the length of the first support section 32. During this period the first belt 28 is continually driven. Upon reaching a preset distance from the feed end 34, the means to vary the length of the first support section 32 stops. The gap 91 is formed and a carriage return means, such as piston assembly 92 returns the carriage to normal operating position with the first belt 28 continuing to be driven by drive roll 42. The carriage return piston 92 comprises a piston cylinder 94 and a piston rod 96 connected between frame 11 and the carriage means 50. The piston has a piston cylinder 94 and a piston rod 96.

In operation a signatures stream is sent from the printing press 12. Optionally there can be one or more conveyance means, such as feed conveyor 14, to convey signature stream 10. The embodiment illustrated in FIGS. 1 and 2, the signature stream is fed from feed belt 16 to the gapping apparatus 24. When no gap is required, the speed at which the signature stream leaves the printing press is maintained at the feed conveyor 14 and the gapping apparatus 24. The signature stream 10 moves on to subsequent processing, such as stacker means 80. Focusing on the gapping apparatus 24, the signature stream first enters the feed end 34 of the first support section 32 of the first belt 28. The signature stream is conveyed by the first support section 32 to the transfer end 36 from which it is transferred to the receiving end 68 of the second support section 66 of the second belt 64. The second support section 66 conveys the signature stream to the discharge end 70. The signature stream continues to move onto the stacking means 80. The stream enters onto the stacker conveyor 84 for stacking. The speed of feed conveyor 16 is equal to the speed of first support surface 32, second support surface 66 and stacker conveyor 84 providing means to move signature stream 10 uniformly at the same speed from the printing press 12 to the stacking means 80.

When a gap is to be formed, the speed of the first support section 32 is controlled to be slower than the speed of the second support section 66. This causes the signatures which are on the second support section 66 to move away from the signatures on the slower first support section 32. Thereby a gap 91 is formed in a signature stream 10. The continuity of the signature stream is thereby interrupted. Where the first support surface 32 is slower than the signature stream 10 from the printing press 12 and the feed belt 14, the signatures are accumulating on the first support section 32 at a greater rate.

In order to prevent signatures from piling up and to maintain a relatively uniform shingle spacing between adjacent shingles, the transfer end 36 is moved away from the feed end 34. Therefore, as the transfer end 36 slowly moves away from the feed end 34 the signature stream 10 ahead of it is moving more rapidly away from the transfer end 36 on the second support section 66. Because the transfer end 36 is moving, preferably at a constant speed, the shingles do not uncontrollably pile up, but rather the shingles spacing "d" is relatively uniformly close forming a uniform, more concentrated shingle stream length on the first support section 32 during the formation of the gap 91.

In the preferred embodiment illustrated in FIGS. 1 and 2, the transfer end 36 moves away from the feed end 34 on carriage means 50. This is accomplished by causing brake roll 48 to stop rotating and the first belt 28 which travels around belt 48 stops rotating at brake roll 48. The drive roll 42 continues to rotate to cause the belt 28 to move at the desired, preferably slower speed than the signature stream from press 12. The rolls 42, auxiliary 60 and feed end roll 38 continue to rotate. The drive roll 42 pulls the brake roll 48 toward it on the carriage means 50. This results in the first belt 28 between brake roll 48 and drive roll 42 getting shorter. This distance is taken up by an increase in length of the first support section 32. The shingles are supported on support section 32, as they continue in a direction from the printer 12 toward the stacker 80. Upon reaching a controlled distance from the feed end 34, the transfer end 36 stops and the brake at brake roll 48 is released. The drive roll 42 resumes a desired speed and the first support section then continues to move from the feed end 34 to the transfer end 36. At this time the carriage return means, such as return piston 92, returns the carriage to initial position for normal operation. During this time the first support section 32 is continually transferring the shingle stream from the first belt 28 to the second belt 64.

The gapping apparatus 24 can be operated in a variety of modes. Because the first support section 32 and the second support section 66 can have different speeds with both support sections continually moving from the direction of the feed end 34 of the first conveyor belt 56 to the discharge end of conveyor belt 62, the shingle stream is continually moved in that direction. The ability of the first support section 32 to vary in length maintains a relatively uniform shingled configuration even when the shingle stream is slowed on the first belt 28 enabling the gap 91 to form.

The first support section 32 and second support section 66 can be operated at relatively different speeds compared to each other and to the shingle stream speed from the printing press. For example, the first support section 32 speed can be ¼ and preferably from ½, and more preferably from ⅔ of the shingle stream speed from the printing press during the time when a gap is formed. The second support section 66 is preferably operated at a greater speed than the first support section 32 during formation of the gap 91. The second support speed section 66, as well as the speed of the stacker conveyor 84 can be as much as 150% or more, than the speed of the shingle stream 10 speed from the printing press 12. By varying the relative speed of the first support section relative to the second support section 66, the gap size end shingle spacing "d" can be controllably reduced.

The shingle space can be reduced up to ⅓ or more. Preferably, the speed of feed belt 14 and the conveyor 84 are maintained at the same speed as the shingle stream 10 which comes from the printing means 12. The speed of the second support surface is likewise maintained at that speed and only the first support section 32 speed is reduced.

It has been found that in operation of the present invention a neat gap is formed in a signature stream. The stream 10 ahead of the gap 91 is uniform; and the stream behind the gap has a closer shingle spacing "d" which is relatively uniform during the length of time and distance that it takes to form the gap 91.

There can be suitable means to prevent errant shingles from slipping out from the gap signature in the gap. This can be accomplished by the use of suitable stop means such as a pinch roll assembly 98. In this assembly the pinch roll 98 can be above the transfer roll 40 to pinch the leading edge of the gap stream between the pinch roll 100 and the transfer end roll 40. This prevents wayward signatures from slipping out into the gap area and creating problems. There can be a second pinch roll assembly 102 which can be made as part of the assembly with the first pinch roll assembly. The second pinch roll 104 is disposed to pinch signatures between pinch roll 104 and end support surface 64 preferably at second support section support means 76, such as second support roll 78. In this way signatures can be pinched at either or both of pinch rolls 100 and 104.

Preferably the distance between the pinch rolls 100 and 104 is at least that of a signature so that no signatures become loose between both of the pinch rolls.

While exemplary embodiments of the invention have been described, the true scope of the invention is to be determined from the following claims.

What is claimed is:

1. An apparatus comprising:

first conveyor belt comprising at least one first belt including a belt axis along the length of said first belt, and a first conveyor belt support section axially extending from a feed end to a transfer end;

a means to drive said first belt at a controlled speed whereby said first conveyor belt support section advances from said feed end to said transfer end;

a brake roll to brake or stop said first conveyor belt, independent from said means to drive;

an accumulator means to vary the length of said first conveyor belt support section while said first belt is being driven;

a second conveyor belt comprising at least one second belt having a second conveyor belt support section axially extending from a receiving end to discharge end, said first and said second belts extending parallel to said belt axis of said first belt and alternating in a direction transverse to said belt axis, with said second conveyor belt support section of said second belt disposed to receive articles from said first conveyor belt; and, a means to drive said second belt whereby said second conveyor belt support section advances from said receiving end to said discharge end.

2. An apparatus comprising:

a first conveyor belt comprising at least one first belt including a belt axis along the length of said first belt, and a first conveyor belt support section axially extending from a feed end to a transfer end, wherein said first conveyor belt further comprises:

a feed end roll;

a transfer end roll; and, a brake roll, wherein said at least one first belt forms a continuous path around said feed end, said transfer end, and said brake roll with said first conveyor belt support section extending from said feed end roll to said transfer end roll;

an accumulator section which extends from said transfer end roll around said brake roll to said feed end roll;

a means to drive said first belt at a controlled speed whereby said first conveyor belt support section advances from said feed end to said transfer end;

an accumulator means to vary the length of said first conveyor belt support section while said first belt is being driven;

a second conveyor belt comprising at least one second belt having a second conveyor belt support section axially extending from a receiving end to a discharge end, said first and said second belts extending parallel to said belt axis and alternating in a direction transverse to said belt axis, with said conveyor belt support section of said second belt disposed to receive articles from said first conveyor belt; and a means to drive said second belt whereby said second conveyor belt support section advances from said receiving end to said discharge end.

3. The apparatus as recited in claim 2 further comprising a transfer roll translation means to enable said transfer roll to axially move.

4. The apparatus as recited in claim 3 wherein said transfer roll translation means comprises a track and a carriage disposed to move along said track interconnected to said transfer roll to move the transfer roll parallel to said belt axis.

5. The apparatus as recited in claim 4 wherein said first conveyor belt further comprises an outer surface and an inner surface, and wherein said brake roll is interconnected to said carriage and being along said continuous path between said transfer roll and said feed end roll.

6. The apparatus as recited in claim 4 further comprising a drive roll along the path between said brake roll and the feed end roll.

7. The apparatus as recited in claim 5 wherein the outer surface of said first conveyor belt travels around part of said brake roll.

8. The apparatus as recited in claim 4 further comprising means to enable said brake roll to move when said transfer roll moves to maintain the length of the continuous path.

9. The apparatus as recited in claim 8 wherein said brake roll is interconnected to said carriage.

10. The apparatus as recited in claim 2 further comprising a first stop means disposed to stop articles on said first conveyor belt.

11. The apparatus as recited in claim 10 wherein said first stop means is a first pinch roll.

12. The apparatus as recited in claim 10 further comprising a second stop means disposed to stop articles on said second conveyor belt.

13. The apparatus as recited in claim 12 wherein said second stop means is a second pinch roll.

14. The apparatus as recited in claim 13 wherein said first stop means is a first pinch roll and the distance between said first and said second pinch rolls is greater than the length of an article in the direction of said belt axis.

15. The apparatus as recited in claim 2 wherein said receiving end of said second conveyor belt is axially located between said feed end and said transfer end of said first conveyor belt.

16. The apparatus as recited in claim 2 wherein said second conveyor belt further comprises a receiving end roll at said receiving end and a discharge end roll at said discharge end, with said second belt forming a continuous path around said receiving end roll and said discharge end roll, with said second support section extending from said receiving end roll to said discharge roll.

17. The apparatus as recited in claim 2 further comprising a second support section support means comprising a plurality of rollers supporting said second conveyor belt support section.

18. The apparatus as recited in claim 17 wherein said second support section support means is connected to said accumulator means.

19. The apparatus as recited in claim 2 further comprising a second support section support means.

20. A system comprising:

a signature stream feed means;

a signature stream interrupt means disposed to receive a signature stream from said signature stream feed means, said signature stream interrupt means comprising:

a first conveyor belt comprising at least one first belt including a belt axis along the length of said first belt, and a first conveyor belt support section axially extending from a feed end to a transfer end;

a means to drive said first belt whereby said first conveyor belt support section advances from said feed end to said transfer end;

a brake roll to brake or stop said first conveyor belt, independent of the means to drive;

an accumulator means to vary the length of said first conveyor belt support section while said first belt is being driven;

a second conveyor belt comprising at least one second belt having a second conveyor belt support section axially extending from a receiving end to discharge end;

a means to drive said second belt whereby said second conveyor belt support section advances from said receiving end to said discharge end, said first and said second belts extending parallel to said belt axis and alternating in a direction transverse to said belt axis, with said second conveyor belt support section of said second belt disposed to receive signatures from said first conveyor belt; and, a signature stacking means disposed to receive said signature stream from said signature stream interrupt means.

21. The system as recited in claim 20 further comprising a printing press which produces a signature stream which is fed to said signature stream feed means.

22. The system as recited in claim 20 wherein said signature stacking means is a vertical stacker.

23. The system as recited in claim 20 wherein said signature stacking means is a horizontal stacker.

24. The apparatus as recited in claim 20 wherein said first conveyor belt further comprises:

a feed end roll;

a transfer end roll; and, a brake roll, wherein said first belt forms a continuous path around said feed end, said transfer end, and said brake roll with said first conveyor belt support section extending from said feed end roll to said transfer end roll; and, an accumulator section extending from said transfer end roll around said brake roll to said feed end roll.

25. A method of forming a gap in a stream of signature comprising the steps of:

feeding a stream of signatures to a first conveyor belt comprising at least one first belt including a belt axis along the length of said first belt, and a first conveyor belt support section axially extending from a feed end to a transfer end;

driving said first conveyor belt from said feed end to said transfer end at a first support surface speed;

transferring said stream of signatures from said transfer end of said first conveyor belt to a second conveyor belt comprising at least one second belt having a second conveyor belt support section axially extending from a receiving end to a discharge end, said first and said second belts extending parallel to said belt axis, with said second conveyor belt support section of said second belt disposed to receive signatures from said first conveyor belt;

driving said second conveyor belt to advance said second conveyor belt from said receiving end to said discharge end at a second support surface speed;

maintaining said first support surface speed of said first conveyor belt support section equal to said second support surface speed of said second support section;

slowing the speed of the first support section relative to the speed of the second support section; and, increasing the length of said first conveyor belt support surface by moving said transfer end toward said discharge end of said second conveyor belt.

26. The method as recited in claim 25 further comprising the steps of:

decreasing said speed of said first conveyor belt support surface to a speed slower than said second conveyor belt support surface; and, increasing the length of said first conveyor belt support surface by moving said transfer end toward said discharge end of said second conveyor belt at the speed said first conveyor belt is being driven.

27. The method as recited in claim 25 further comprising:

stopping the movement of said transfer end of said first conveyor belt;

driving said first support surface at the same speed as said second support surface; and, returning said transfer end to a position closer to said feed end.

* * * * *